US011130147B2

(12) United States Patent
Hidaka

(10) Patent No.: US 11,130,147 B2
(45) Date of Patent: Sep. 28, 2021

(54) SUCK BACK TYPE INTERMITTENT COATING SYSTEM

(71) Applicant: Sun Tool Corporation, Moriguchi (JP)

(72) Inventor: Shoji Hidaka, Moriguchi (JP)

(73) Assignee: Sun Tool Corporation, Moriguchi (JP)

( * ) Notice: Subject to any disclaimer, the term of this patent is extended or adjusted under 35 U.S.C. 154(b) by 188 days.

(21) Appl. No.: 16/472,772

(22) PCT Filed: Jun. 28, 2017

(86) PCT No.: PCT/JP2017/025060

§ 371 (c)(1),
(2) Date: Jun. 21, 2019

(87) PCT Pub. No.: WO2018/116508

PCT Pub. Date: Jun. 28, 2018

(65) Prior Publication Data

US 2021/0129172 A1 May 6, 2021

(30) Foreign Application Priority Data

Dec. 23, 2016 (JP) ..... JP2016-257973

(51) Int. Cl.

*B05C 5/02* (2006.01)
*B05C 11/10* (2006.01)
*B05B 1/30* (2006.01)

(52) U.S. Cl.

CPC ..... *B05C 5/0225* (2013.01); *B05B 1/3053* (2013.01); *B05C 5/0237* (2013.01); *B05C 11/1034* (2013.01)

(58) Field of Classification Search

CPC ..... B05C 5/02; B05C 5/0225; B05C 5/0258; B05C 5/0275; B05C 11/1026; B05C 11/1034; B05C 5/0237; B05B 1/3053

(Continued)

(56) References Cited

U.S. PATENT DOCUMENTS 5,100,699 A * 3/1992 Roeser ..... B29B 7/749 118/302
5,584,597 A * 12/1996 Lemelson ..... E01C 23/06 299/41.1
5,881,914 A * 3/1999 Tsuda ..... B05C 11/10 222/54

FOREIGN PATENT DOCUMENTS

JP 5-111658 A 5/1993
JP 10-192763 A 7/1998

(Continued)

OTHER PUBLICATIONS

International Search Report dated Oct. 3, 2017 issued to PCT International Application No. PCT/JP2017/025060.

*Primary Examiner* — Laura Edwards
(74) *Attorney, Agent, or Firm* — Norton Rose Fulbright US LLP

(57) ABSTRACT

A suck back type intermittent coating system including a valve mechanism, a valve manipulating mechanism, and a solenoid valve for controlling the operation of the valve manipulating mechanism; and a control device that inputs therein a pulse signal indicative of the travel state (travel speed, etc.) of a base material traveling along a coating line, and outputs an electrical command to the solenoid valve. A displacement sensor for detecting a displacement of the movable valve body of the valve mechanism is provided so that the operation of the valve manipulating mechanism is remotely controlled by a command signal to the solenoid valve; and with a computer having a feedback function that issues a correction signal to the operation of the solenoid valve confirmation and tally of the operation of a coating gun module is performed even when away from a production line.

1 Claim, 8 Drawing Sheets

(58) Field of Classification Search
USPC ..... 118/684, 710, 712, 300, 429
See application file for complete search history.

(56) References Cited

FOREIGN PATENT DOCUMENTS

| | | | |
|---|---|---|---|
| JP | 11-347473 | A | 12/1999 |
| JP | 2004-141707 | A | 5/2004 |
| JP | 2004-148184 | A | 5/2004 |
| JP | 2005-222911 | A | 8/2005 |
| JP | 2006-51407 | A | 2/2006 |
| JP | 2010-188289 | A | 9/2010 |
| JP | 2013-69645 | A | 4/2013 |

* cited by examiner

SUCK BACK TYPE INTERMITTENT COATING SYSTEM

CROSS REFERENCES TO RELATED APPLICATIONS

This application is a national stage application pursuant to 35 U.S.C. 371 of International Application No. PCT/JP2017/025060, filed on Jun. 28, 2017 which claims priority under 35 U.S.C. § 119 to Japanese Patent Application No. 2016-257973 filed on Dec. 23, 2016, the disclosures of which are hereby incorporated by reference in their entireties.

FIELD OF THE INVENTION

The present invention relates to an intermittent coating system that includes a suck back type intermittent coating device for intermittently applying a liquid adhesive to a coating base material at high speed.

PRIOR ART DOCUMENTS

As a suck back type intermittent coating device for intermittently applying a liquid adhesive to a coating base material at high speed, there is an intermittent coating device characterized in that the device clarifies a boundary line at the edges of a coating section on a coating surface a coating base material by using a valve mechanism that includes a valve body having an enlarged part formed to produce a suction action during the intermittent supply of liquid adhesive to the coating base material (Patent Document 1: Japanese Patent Application Laid-Open No. H10-192763).

In this intermittent coating device described above, the selection of the ON and OFF operation of the valve mechanism, that is, the operation to raise and lower the valve body, involves a supply operation of air by controlling the operation of the solenoid valve.

In the intermittent coating device of this type, the solenoid valve is controlled on the basis of confirmation of the coating state of the coating base material by visual observation of the coating surface.

Patent Documents

Patent Document 1: Japanese Patent Application Laid Open No. H10-192763

Patent Document 2 Japanese Patent Application Laid Open No. H11-347473

SUMMARY OF THE INVENTION

Problems to be Solved by the Invention

The "Intermittent Coating Device" of Japanese Patent Application Laid Open No. H11-347473 (Patent Document 2) discloses a remote control of a coating state that involves computer control of intermittent coating, by means of a computer control (sequencer control) involving sensing of the level of coating agent by a liquid level detector (sensor head). However, this is a detection of the liquid level, and it not a detection of the coating surface produced by intermittent coating, and there is no technique for detecting the coating section of the coating surface.

It is an object of the present invention to make a remote control of a coating state by computer control possible in a suck back type intermittent coating device that clarifies the front and rear boundary lines of a coating section.

Specifically, it is an object to make it possible to perform remote control by clearly detecting the front edge position and the rear edge position of a coating section by sensing the timing of the ascending position and the descending position of a movable valve body in a suck back type intermittent coating device. It is also an object to confirm whether the ascending and descending operation of the movable valve body of the valve mechanism is performed normally.

A method for an on-site confirmation of the coating state (coating position, coating length, etc.) of a coating base material W traveling along a coating line with a hot-melt adhesive HM (a method in which the displacement sensor of the present invention is not used) will now be described with reference to FIG. 10.

A suck back type intermittent coating device 101 includes a valve mechanism 102, a valve manipulating mechanism 103 for manipulating the up and down motion of a movable valve body 20 of the valve mechanism 102, and a solenoid valve 104 for controlling the operation of the valve manipulating mechanism 103; and it further includes a control device 110 which is provided to input thereinto from an encoder 109 a pulse signal Sp indicative of the travel state (travel speed, etc.) of a base material W traveling along a coating line and to output an electrical command Sg to the solenoid valve 104.

The control device 110 has a function to set a coating start position and a coating length, and the ON and OFF positions of the movable valve body are set in the control device by visual observation of the coating position and coating length at a product production site.

In order to set the coating position and coating length in the control device, it is necessary to visually observe the coating position and coating length at the product production site.

Accordingly, a problem rises that it is not possible to automate the production site, and thus it is an object of the present invention to eliminate the need for visual inspection of the coating position and coating length and to make an automated production site possible.

Means for Solving the Problems

The first invention of the present application provides a suck back type intermittent coating system comprising: a suck back type intermittent coating device 1 including a valve mechanism 2, a valve manipulating mechanism 3 for manipulating the up and down motion of a movable valve body 20 of the valve mechanism 2, and a solenoid valve 4 for controlling the operation of the valve manipulating mechanism 3; and a control device 10 that inputs therein a pulse signal Sp, which is from an encoder 9 and is indicative of the travel state (travel speed, etc.) of a base material W traveling along a coating line, and outputs an electrical command Sg to the solenoid valve 4, wherein a displacement sensor for detecting a displacement of the movable valve body 20 is provided so that the detection signal from the displacement sensor is inputted to the control device 10;

the control device 10, under a computer control thereof, remotely confirms a coating state, including a coating position and a coating length and remotely controls an operation of the valve manipulating mechanism by outputting a command signal to the solenoid valve; and the control device is provided with a computer having a feedback function that issues a correction signal to the operation of the solenoid valve by storing the amount of lag in air drive of the suck back valve mechanism 2 with respect to the record of computer control settings (coating section setting, coating start position setting, etc.);

so that confirmation and tally of the operation of a gun module being operated can be performed even when away from the production line.

The second invention of the present application provides a suck back type intermittent coating system comprising: a suck back type intermittent coating device 1 including a valve mechanism 2, a valve manipulating mechanism 3 for manipulating the up and down motion of a movable valve body 20 of the valve mechanism 2, and a solenoid valve 4 for controlling the operation of the valve manipulating mechanism 3; and a control device 10 that inputs therein a pulse signal Sp, which is from an encoder 9 and is indicative of the travel state (travel speed, etc.) of a base material W traveling along a coating line, and outputs an electrical command Sg to the solenoid valve 4, wherein a displacement sensor for detecting a displacement of the movable valve body 20 is provided so that the detection signal from the displacement sensor is inputted to the control device 10, and the ON and OFF operation of the valve mechanism is remotely controlled under sequence control by a computer.

The third invention of the present application provides the suck back type intermittent coating system of the above-described second invention, wherein in the sequence control by the computer, a solenoid valve ON operation signal is generated at the conclusion of a solenoid valve OFF operation signal, and solenoid valve ON operation signals are continuously outputted for a set length of time on the basis of the detection of the ON operation position of the movable valve body; and a solenoid valve OFF operation signal is generated at the conclusion of a solenoid valve ON operation signal, and solenoid valve OFF operation signals are continuously outputted for a set length of time on the basis of the detection of the OFF operation position of the movable valve body;

so that the ON and OFF operation of the valve mechanism is thus remotely controlled on the basis of the detection signal from the displacement sensor.

The fourth invention of the present application provides a remote operation method for a suck back type intermittent coating system comprising: a suck back type intermittent coating device 1 including a valve mechanism 2, a valve manipulating mechanism 3 for manipulating the up and down motion of a movable valve body 20 of the valve mechanism 2, and a solenoid valve 4 for controlling the operation of the valve manipulating mechanism 3; and a control device 10 that inputs therein a pulse signal Sp, which is from an encoder 9 and is indicative of the travel state (travel speed, etc.) of a base material W traveling along a coating line, and outputs an electrical command Sg to the solenoid valve 4, wherein with a displacement sensor which is for detecting a displacement of the movable valve body 20 and is provided so that the detection signal from the displacement sensor is inputted to the computer of the control device 10, the method performs an ON operation display on the basis of the generation of the displacement sensor ON detection positon signal Sa, performs an OFF operation display on the basis of the generation of the displacement sensor OFF detection position signal Sb, gives an abnormal display warning when the numerical value for the duration of the ON operation display is outside of a set value range, and gives an abnormal display warning when the numerical value for the duration of the OFF operation display is outside of a set value range, so that malfunction of the valve mechanism is thus automatically detected and a warning is issued.

The fifth invention of the present application provides a remote operation device for a suck back type intermittent coating system comprising: a suck back type intermittent coating device 1 including a valve mechanism 2, a valve manipulating mechanism 3 for manipulating the up and down motion of a movable valve body 20 of the valve mechanism 2, and a solenoid valve 4 for controlling the operation of the valve manipulating mechanism 3; and a control device 10 that inputs therein a pulse signal Sp, which is from an encoder 9 and is indicative of the travel state (travel speed, etc.) of a base material W traveling along a coating line, and outputs an electrical command Sg to the solenoid valve 4, wherein the remote operation device is provided with a displacement sensor which is for detecting a displacement of the movable valve body so that the detection signal from the displacement sensor is inputted to the computer of the control device 10; and the computer functioning as:

an A timer means for measuring the duration of an ON operation display;

a B timer means for measuring the duration of an OFF operation display;

an A determination means for determining whether the numerical value for the duration A indicated by the A timer means is inside or outside of the set value;

a B determination means for determining whether the numerical value for the duration B indicated by the B timer means is inside or outside of the set value; and a warning means for showing a normal display when the determination result of the A determination means indicates normal and the determination result of the B determination means indicates normal, and showing an abnormality warning display when the determination result of the A determination means indicates abnormal and when the determination result of the B determination means indicates abnormal, so that malfunction of the valve mechanism is thus automatically detected and a warning is issued.

Effects of the Invention

The present invention provides a suck back type intermittent coating device in which a valve mechanism with a valve body structure thereof having a suck back action is provided in the lower part of a valve housing, and a solenoid valve selectively supplying operating air to a first operating air opening that opens into the upper inner chamber of the housing and to a second operating air opening that opens into the lower inner chamber of the housing, and in this device, the ON and OFF operation of the valve mechanism is performed by remote control under a computer sequence control on the basis of the detection of the distal end position of an extended portion of the movable valve body by the displacement sensor or under a computer control on the basis of the detection signal from the displacement sensor. Accordingly, the invention has an effect that in an intermittent coating by the suck back type intermittent coating device, the boundary lines of the front edge and the rear edge of a coating section can be clarified, and confirmation and setting of the coating position and coating length can be ensured by remote control.

The invention has another effect that the normal operation of ascent and descent of the movable valve body of the valve mechanism can be remotely confirmed.

The invention has still another effect that since a confirmation of the coating area of the suck back type intermittent coating device is possible remotely, the production site can be automated.

PREFERRED EMBODIMENT OF THE INVENTION

Figure 1:
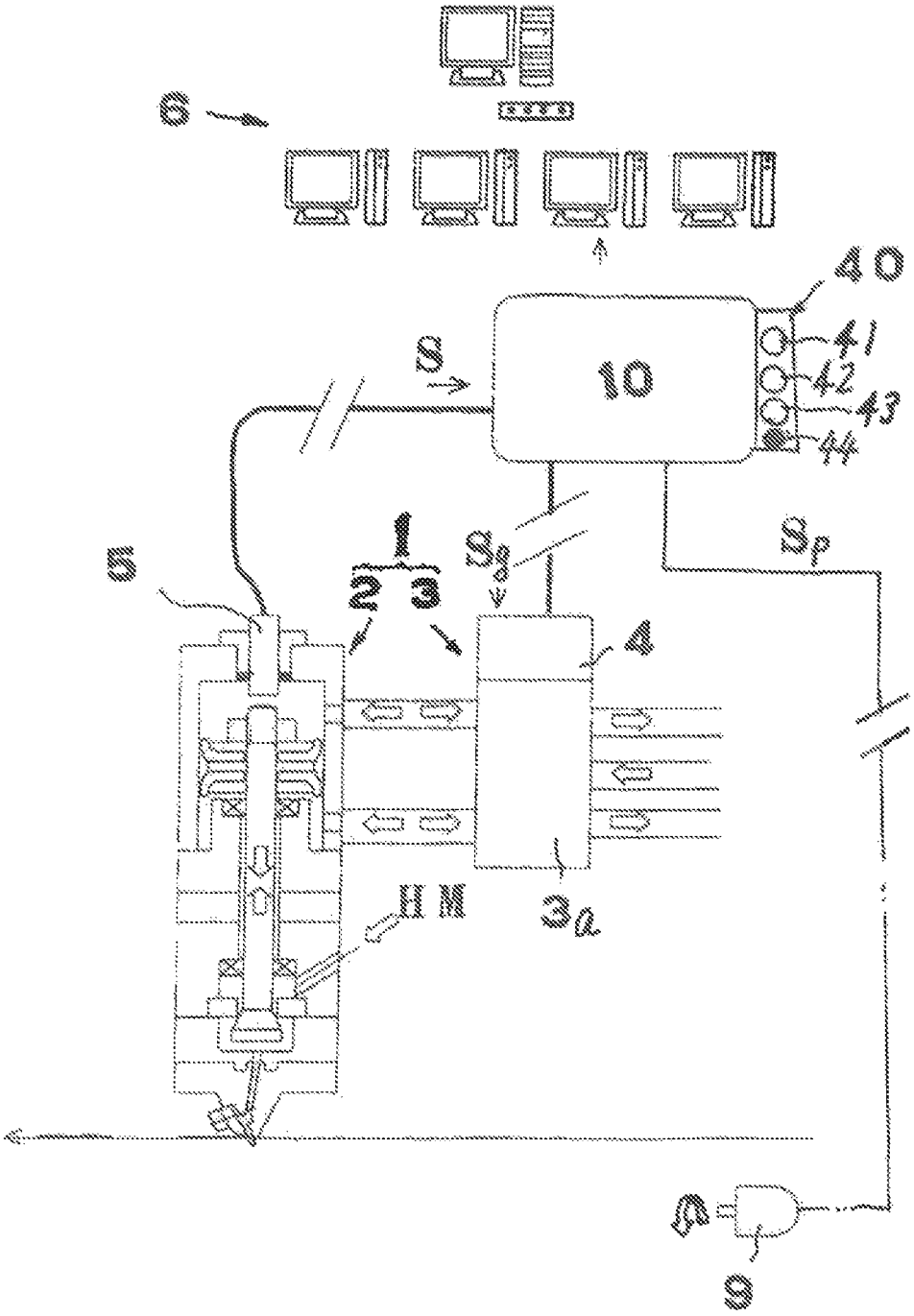
[FIG. 1] A simplified diagram illustrating remote operation of a suck back type intermittent coating system according to the present invention.

A suck back type intermittent coating system includes a suck back type intermittent coating device 1 and a control device 10. The coating device 1 is comprised of a valve mechanism 2, a valve manipulating mechanism 3 for manipulating the up and down motion of a movable valve body 20 of the valve mechanism 2, and a solenoid valve 4 for controlling the operation of the valve manipulating mechanism 3. The control device 10 inputs thereinto from an encoder 9 a pulse signal Sp indicative of the travel state (travel speed, etc.) of a base material W traveling along a coating line, and outputs an electrical command Sg to the solenoid valve 4. In this system, a displacement sensor for detecting the displacement of the movable valve body 20 is provided, so that the detection signal from the displacement sensor is inputted to the control device 10, and a command signal to the solenoid valve is outputted under sequence control by a computer of the control device 10, thus the operation of the valve manipulating mechanism is remotely controlled.

In working the present invention, the valve mechanism of a valve body structure having a suck back action is provided in the lower part of a valve housing.

In the valve mechanism described above, an enlarged part is formed at the lower end of the movable valve body, so that the enlarged part serves as a valve seat that partitions the valve chamber. The opening and closing (ON operation and OFF operation) of the valve is performed by the ascent and descent of the movable valve body.

The valve housing has an internal space formed in the upper part thereof. This internal space is separated vertically by a partition to form two chambers: an upper internal chamber and a lower internal chamber.

An extended portion of the movable valve body passes through the partition.

The housing side walls are provided with a first operating air opening, which opens into the upper inner chamber, and a second operating air opening in the lower inner chamber.

In the suck back type intermittent coating device having the above described configuration, a heat-resistant displacement sensor is provided on the top wall of the housing. The sensing part of this heat-resistant displacement sensor is provided so as to face the distal end of the extended portion of the movable valve body.

The detection signal from the displacement sensor is inputted to the sequence controller of the computer, and the sequence control described below is performed. A coating setting time T1 corresponding to a coating state is set.

An uncoating setting time T2 corresponding to an uncoating state is set. The start of the coating section is determined from when the detection signal from the displacement sensor indicates the starting point of the valve opening (ON operation) position of the movable valve body.

After this, outputting of the solenoid valve ON operation signal is continued for the coating setting time T1. The outputting of solenoid valve ON operation signal ends at the elapse of the coating setting time T1, and change is made to output the solenoid valve OFF operation signal. The start of the uncoating section is determined from when the detection signal from the displacement sensor indicates the starting point of the valve closing (OFF operation) position of the movable valve body.

After this, outputting of the solenoid valve OFF operation signal is continued during the uncoating setting time T2.

The output of the solenoid valve OFF operation signal is ended at the elapse of the uncoating setting time T2, and then change is made to output the solenoid valve ON operation signal.

By detecting how long it takes for the movable valve body of the valve mechanist go, up and down, the operating state of the ON operation and OFF operation of the valve mechanism are remotely confirmed.

Embodiments

The present invention will now be described in detail based on the working examples shown in the accompanying drawings.

A method for remotely confirming the coating state (coating position, coating length, etc.) of a hot melt adhesive HM on a base material W traveling along the coating line will be described with reference to FIG. 1.

The suck back intermittent coating system is formed with the suck back type intermittent coating device 1 and the control device 10.

The suck back type intermittent coating device 1 is comprised of a suck back valve mechanism 2, a valve manipulating mechanism 3 for manipulating the up and down motions of the movable valve body 20 of the suck back valve mechanism 2, and a solenoid valve 4 for controlling the operation of the valve manipulating mechanism 3. The control device 10 inputs in itself from an encoder 9 a pulse signal Sp indicative of the traveling state (travel speed, etc.) of the base material W traveling along the coating line and outputs an electrical command Sg to the solenoid valve 4.

A displacement sensor 5 is provided for detecting the displacement of the movable valve body 20 of the suck back valve mechanism 2.

A detection signal S3 from the displacement sensor is inputted to the control device 10.

The control device 10 is equipped with a computer controller having a function of setting and displaying the ON and OFF operations, a touch panel, and the like. In FIG. 1, EP is a power supply.

The pulse signal Sp indicative of the travel state (traveling speed, etc.) of the base material W traveling along the coating line is inputted from the encoder 9 to the computer controller of the control device 10; and the electrical command Sg is outputted from the computer controller of the control device 10 to the solenoid valve 4, so that the valve manipulating mechanism 3 is controlled by the solenoid valve 4.

Furthermore, an operation display 6 is provided to display the control state from the computer controller.

The computer controller of the control device 10 has a feedback function in which a correction signal is imparted to the operation of the solenoid valve by storing the amount of lag in the air drive with respect to the suck back valve mechanism 2 in the record of the settings (coating section setting, coating start position setting, etc.).

Thus, even when it is far away from the production line, conducting of confirmation and tally of the operation of a gun module being operated is possible.

The suck back valve mechanism 2 and the valve manipulating mechanism 3 will now be described in detail with reference to FIG. 2, as a specific working example of the suck back type intermittent coating device 1.

In this suck back type intermittent coating device 1, the suck back valve mechanism 2, which provides a suck back effect, is disposed in the interior of a valve housing 11.

The suck back valve mechanism 2 is configured so that, with an enlarged part 21 formed at the lower end of the movable valve body 20, valve opening and closing (ON and OFF operation) made by the up and down motion of the movable valve body 20 from and toward a valve seat 22 that partitions the valve chamber 23 is accomplished. An adhesive supply port 17 is formed so that it opens the valve chamber 23, and an adhesive (hot melt adhesive HM) is supplied into the valve chamber 23.

Next, the valve manipulating mechanism 3 will be described.

Figure 2:
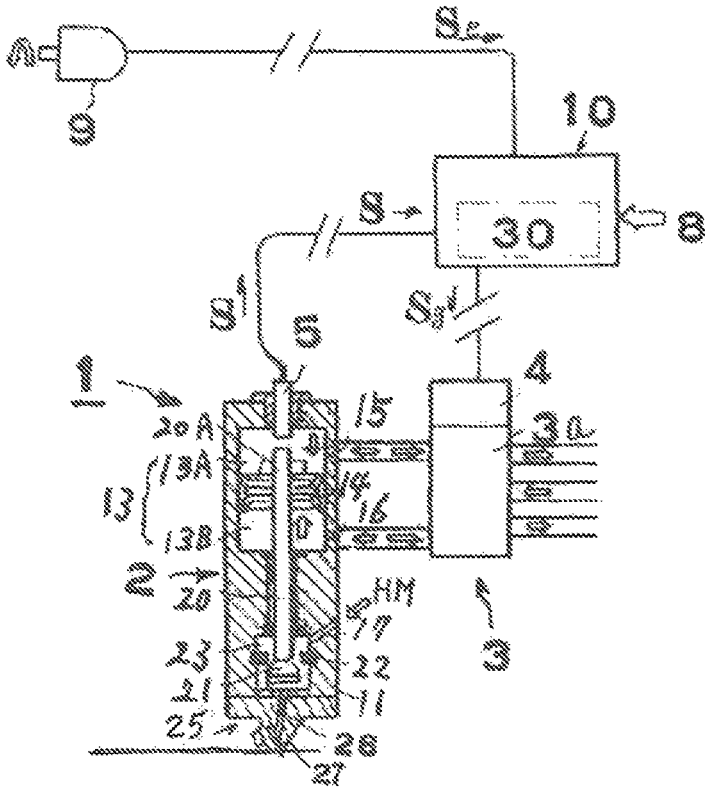
[FIG. 2] A simplified diagram of the suck back type intermittent coating system of the present invention.
Figure 3:
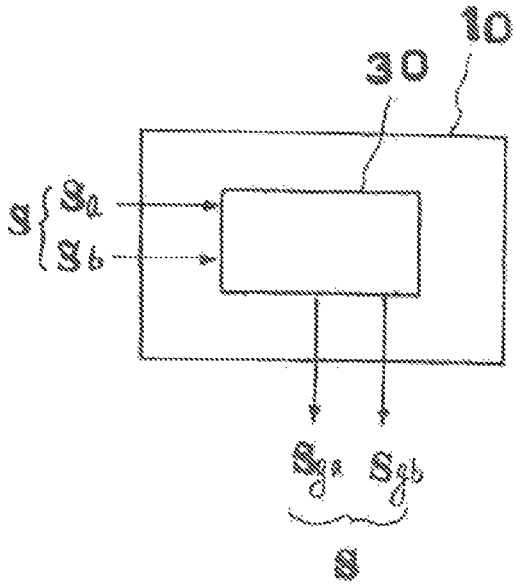
[FIG. 3] A diagram illustrating a signal to a sequence part of a computer.
Figure 4:
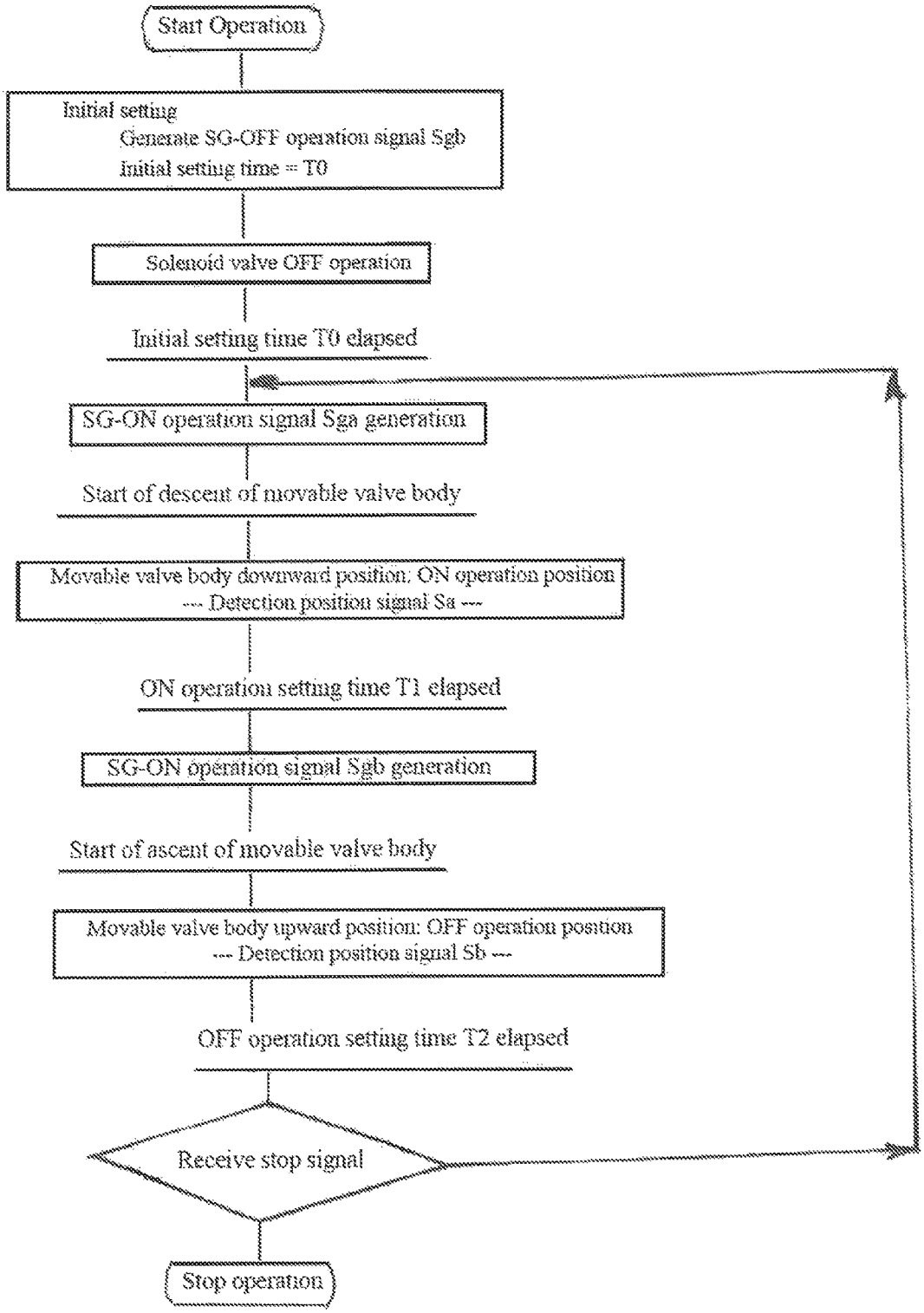
[FIG. 4] A diagram illustrating temporal flow in the sequence control by the computer.

An internal space 13 is, as seen from FIG. 2, formed in the upper part of the valve housing 11, and this internal space 13 is vertically partitioned by a partition 14 to form two chambers: an upper inner chamber 13A and a lower inner chamber 13B.

An extended portion 20A of the movable valve member 20 passes through the partition 14.

The side walls of the valve housing 11 is provided with a first operating air opening 15 that opens into the upper inner chamber 3A, and a second operating air opening 16 in the lower inner chamber 3B.

A five-way valve 3*a* for selectively supplying operating air is provided to the first operating air opening 15 and the second operating air opening 16.

The heat-resistant displacement sensor 5 is provided on the top wall of the housing 11 so that its sensing part faces the extended portion 20A of the movable valve body 20.

In FIG. 2, 25 is a coating head that includes a hot melt supply passage 26 and a hot melt coating slit 27.

The five-way valve 3*a* of the valve manipulating mechanism 3 is manipulated by the solenoid valve 4.

The reference numeral 10 is a computer in an operation management component. The computer 10 is equipped with a sequence control 30 that functions to input thereinto the displacement detection signal S3 from the displacement sensor 5 and to output the electromagnetic operation signal Sg to the solenoid valve 4. The computer further functions to input therein a base material travel information (pulse input) Se from the encoder 9, to output an operation confirmation/warning signal Sp to a warning device, an operating state display device 40, etc., and to perform a remote control/remote confirmation of the coating position and coating length, an operation confirmation, an operation tallying, a confirmation of the production status, and so forth.

The operation of the sequence control 30 will now be described with reference to FIGS. 3 to 7.

| | |
|---|---|
| | Start operation |
| Step 1 | Initial setting |
| | SG-OFF operation signal: Sgb generation Initial setting |
| | time = T0 |
| Step 2 | Solenoid valve OFF operation |
| Step 3 | Initial setting time T0 elapsed |
| Step 4 | SG-ON operation signal: Sga generation |
| Step 5 | Start of descent of movable valve body |
| Step 6 | Movable valve body downward position: ON operating position |
| | . . . Detection position signal Sa . . . |
| Step 7 | ON operation setting time T1 elapsed |
| Step 8 | SG-OFF operation signal: Sgb generation |
| Step 9 | Start of ascent of movable valve body |
| Step 10 | Movable valve body upward position: OFF operation position |
| | . . . Detection position signal Sb . . . |
| Step 11 | OFF operation setting time T2 elapsed |
| | Operation is then repeated until a stop signal is received. |
| | . |
| | . |
| | . |
| | Stop operation |

Next, the operation of the solenoid valve 4 will be described.

Figure 5:
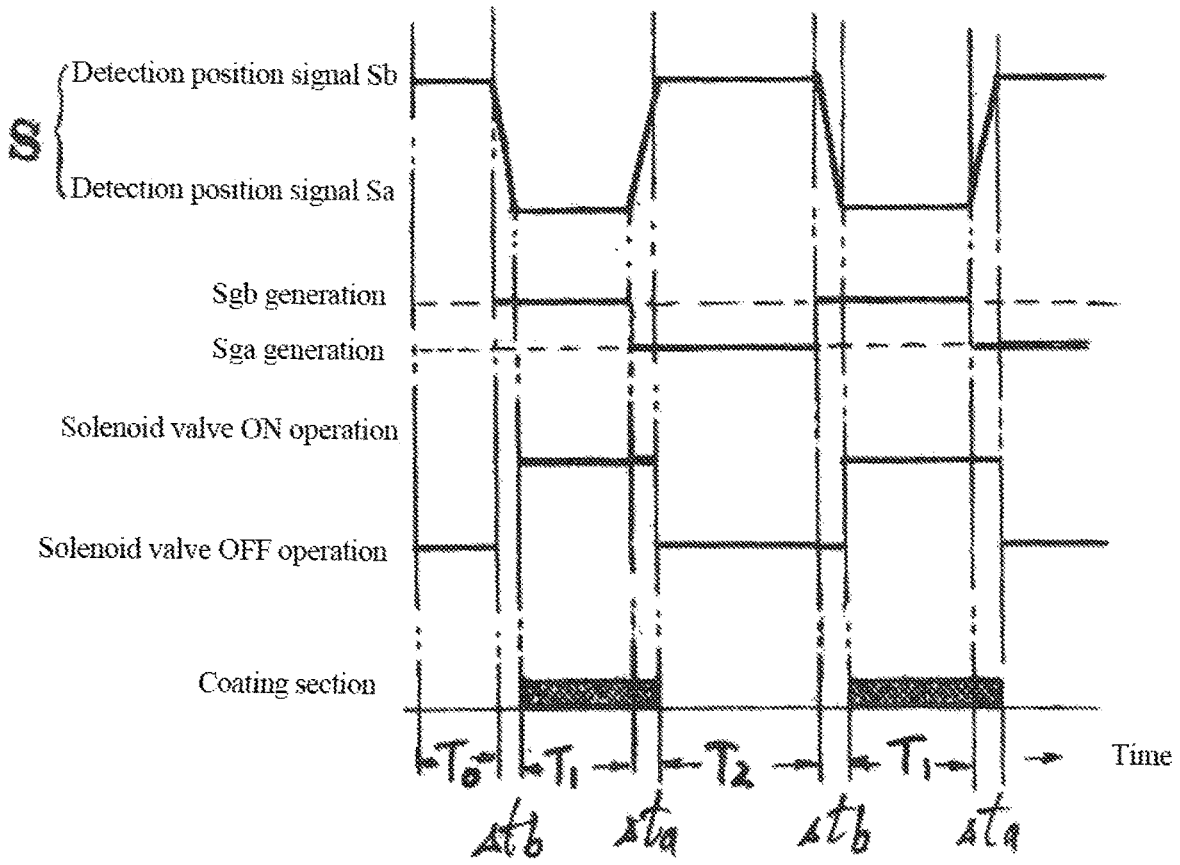
[FIG. 5] A sequence control diagram for the computer.

FIG. 5 shows the start of the generation of the SG-ON operation signal Sga, and it also shows that the movable valve body 20 starts moving downward when operating air is supplied to the upper inner chamber 13A and operating air is drawn into the lower inner chamber 13B, that is, the start of descent of the movable valve body from the upward position of the closing (OFF operation) of the movable valve body to the downward position of the opening (ON operation) of the movable valve body.

Figure 6:
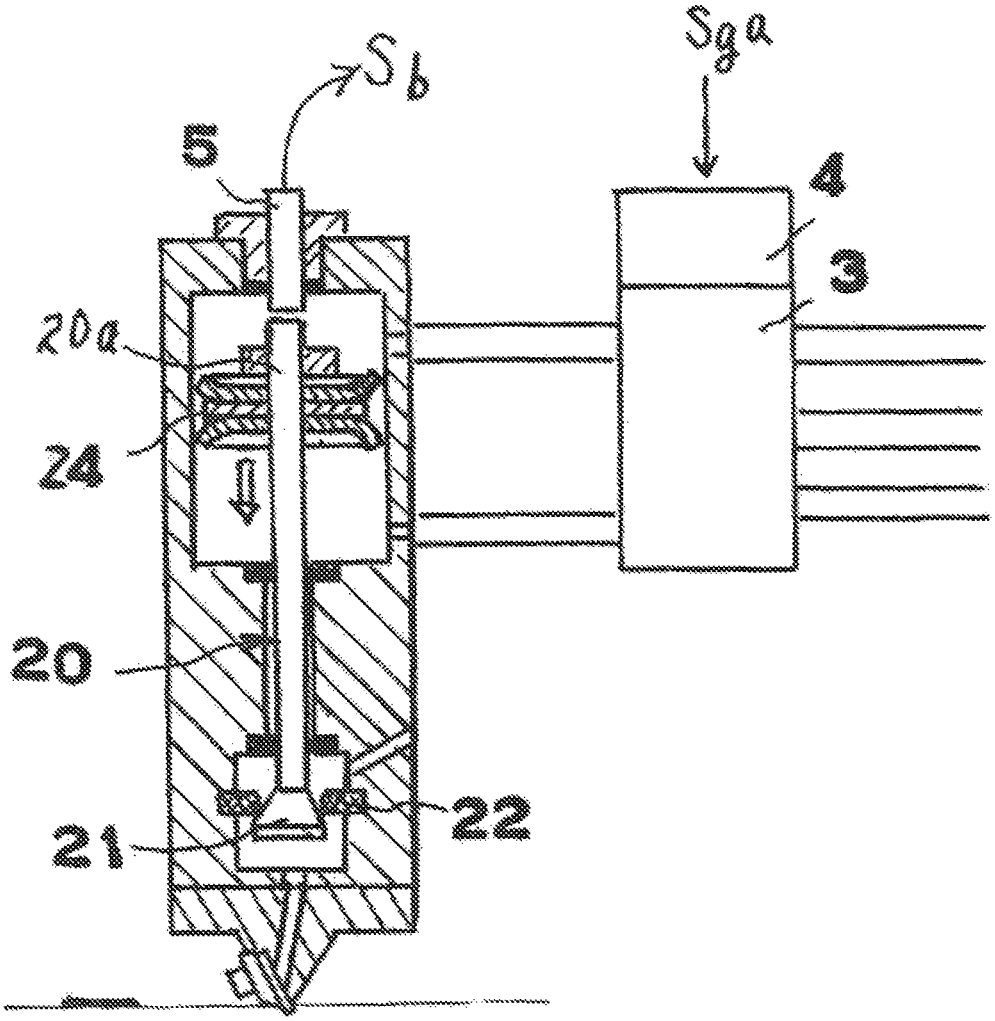
[FIG. 6] A diagram illustrating the relation between the suck back type intermittent coating device and the solenoid valve operation, showing a point when the movable valve body has begun to descend from the upward position of the closed (OFF operation) movable valve body to the downward position of the open (ON operation) movable valve body.
Figure 7:
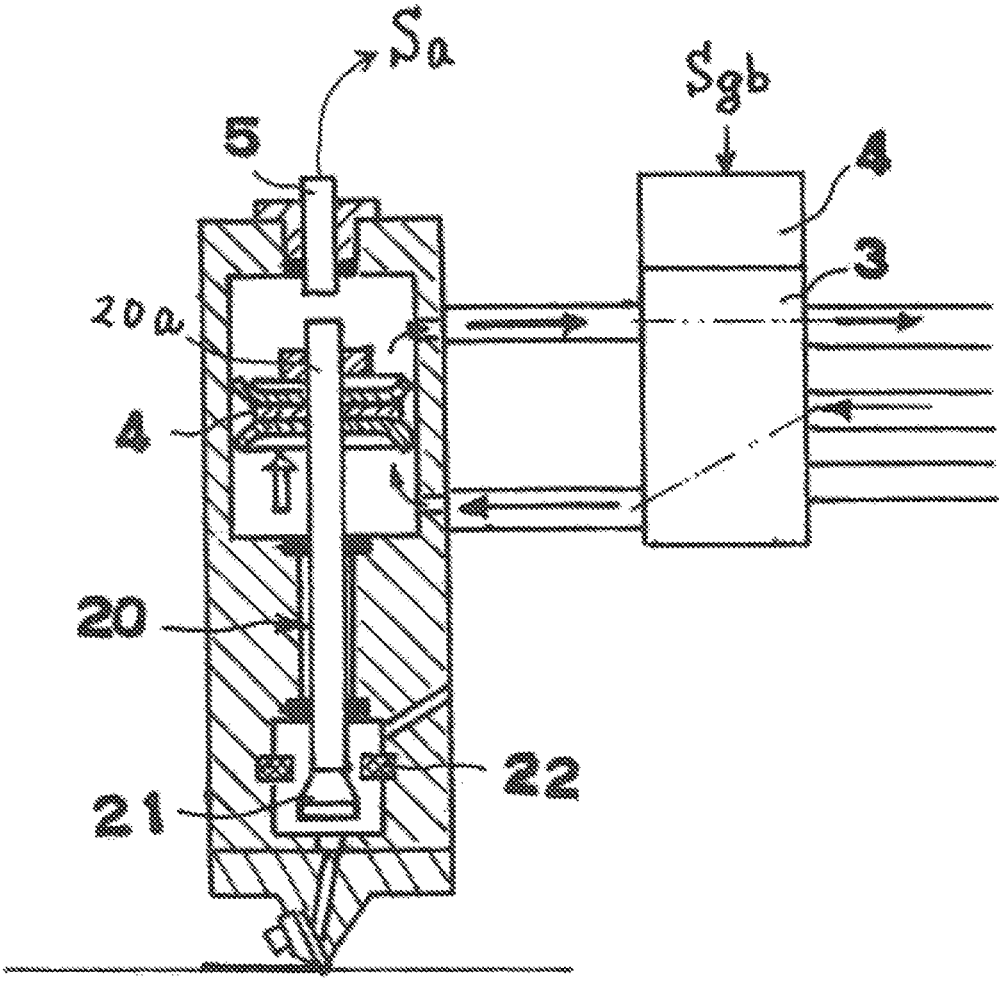
[FIG. 7] A diagram illustrating the relation between the suck back type intermittent coating device and the solenoid valve operation, showing a point when the movable valve body has begun to ascend from the downward position of the open (ON operation) movable valve body to the upward position of the closed (OFF operation) movable valve body valve.

FIG. 6 shows the start of the generation of the SG-OFF operation signal Sgb, and it also shows that the movable valve body 20 starts moving upward when operating air is supplied to the lower inner chamber 13B and operating air is drawn into the upper inner chamber 13A, that is, the start of ascent of the movable valve body from the downward position of the opening (ON operation) of the movable valve body to the upward position of the closing (OFF operation) of the movable valve body.

In the computer 30 of the control device 10, the sequence control inputs the displacement detection signal S3 from the displacement sensor 5, determines this signal to be either a detection position signal S3*a* indicative of the movable valve body downward position (ON operation position) or a detection position signal S3*b* indicative of the movable valve body upward position (OFF operation position), and sequentially controls the operation of the solenoid valve 4, and inputs base material travel information (pulse input) Se from the encoder 9, so that the coating state on the coating base material is remotely confirmed, thereby outputting an operation confirmation/warning signal Sp to a warning device/operating state display device 40, and performing remote control/remote confirmation of the coating position and coating length, operation confirmation, operation tallying, and confirmation of the production status. Therefore, the present invention allows a suck back type intermittent coating system to be operated by remote control and eliminates the need to visually check the coating surface in a conventional system.

The computer 30 is equipped with an up-down operation confirmation and warning component 40 for the movable valve body 20.

As seen from FIG. 1, the up-down operation confirmation and warning component 40 for the movable valve body is constituted by a calculating function 41 for calculating the movable valve body descent time $\Delta t_1$, a calculating function 42 for calculating the movable valve body ascent time $\Delta t_2$, a calculating function 43 for determining the allowable range of the movable valve body descent time $\Delta t_1$, and a calculating function 44 for determining the allowable range of the movable valve body ascent time $\Delta t_2$.

The calculating function 41 calculates the movable valve body descent time $\Delta t_1$ calculates how long it takes from the generation of the SG-ON operation signal Sga to the generation of the detection position signal Sa, as shown in FIG. 5.

The calculating function 42 calculates the movable valve body ascent time $\Delta t_2$ calculates how long it takes from the generation of the SG-OFF operation signal Sgb to the generation of the detection position signal Sa, as shown in FIG. 5.

The calculating function 43 determines the allowable range of the movable valve body descent time Δta determines whether the inputted movable valve body descent time Δta is normal or abnormal, using a setting reference value Δtas±10% as the allowable range. The calculating function 44 determines the allowable range of the movable valve body ascent time Δtb determines whether the inputted movable valve body ascent time Δtb is normal or abnormal, using a setting reference value Δtbs±10% as the allowable range.

Based on the determination result, a normal signal Sp or an abnormal signal Sq is generated and a normal display 45 or an abnormality warning 46 is produced.

The calculating function 41 for calculating the movable valve body descent time Δta and the calculating function 42 for calculating the movable valve body ascent time Δtb may use the timer function of the computer. That is, the input of the SG-ON operation signal Sga causes the timer mechanism to calculate the movable valve body descent time Δta by means of the count start, the number of picoseconds tallied, and the count stop by input of the detection position signal Sa.

The operating state of the ON and OFF operations of the valve mechanism is thus remotely checked by detecting how long it takes for the movable valve body of the valve mechanism to ascend descend.

The numerical values in specific working examples of the present invention are listed below, merely for the sake of reference, and are not intended to limit the present invention.

ON operation setting time T1=0.03 seconds

OFF operation setting time T2=0.04 seconds

Movable valve body descent time $\Delta t_1$=0.003 seconds

Movable valve body ascent time $\Delta t_2$=0.004 seconds

Difference in head of movable valve body=1.0 mm

Travel speed of coating base material=100 meters/minute

Coating length=50 mm

Uncoating length=50 mm

On remotely checking the operating state of the ON and OFF operation of the valve mechanism by detecting how long it takes the movable valve body of the valve mechanism to move up and down, the allowable ranges are set as follows:

Moving valve body descent time $\Delta t_1$=0.003 sec±0.0005 sec

Moving valve body ascent time $\Delta t_2$=0.004 sec±0.0005 sec

As shown in FIG. 1, an operating state display device 40 is provided for the control device 10.

Figure 8:
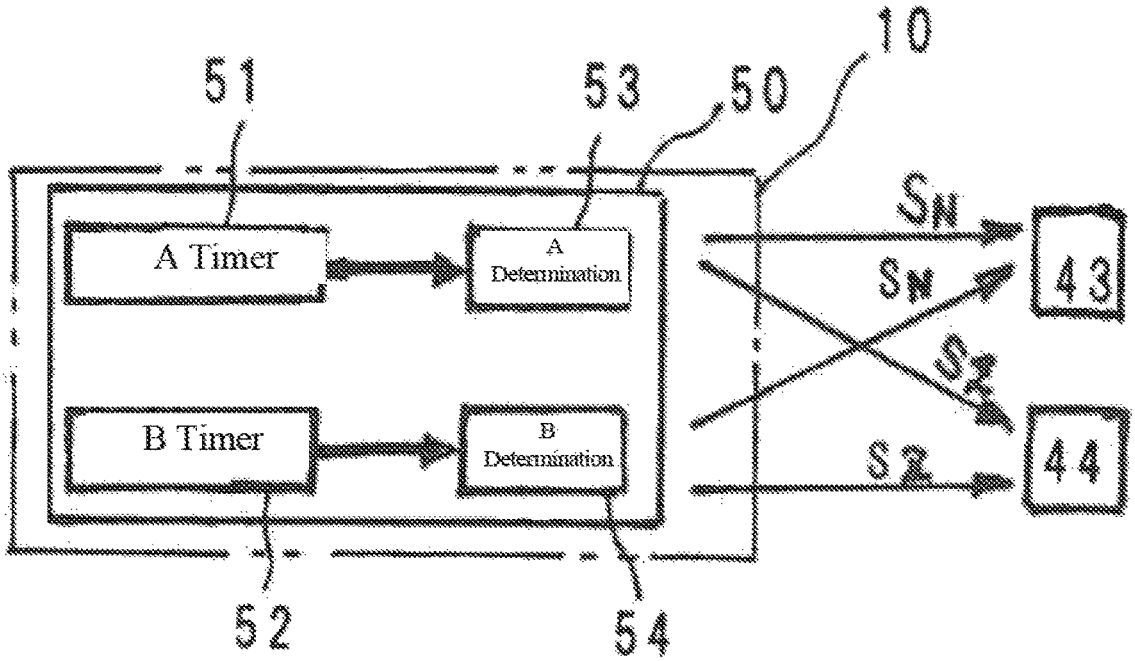
[FIG. 8] A block diagram of a computer function for automatically detecting an abnormality in the valve mechanism and issuing a warning, for remote confirmation.
Figure 9:
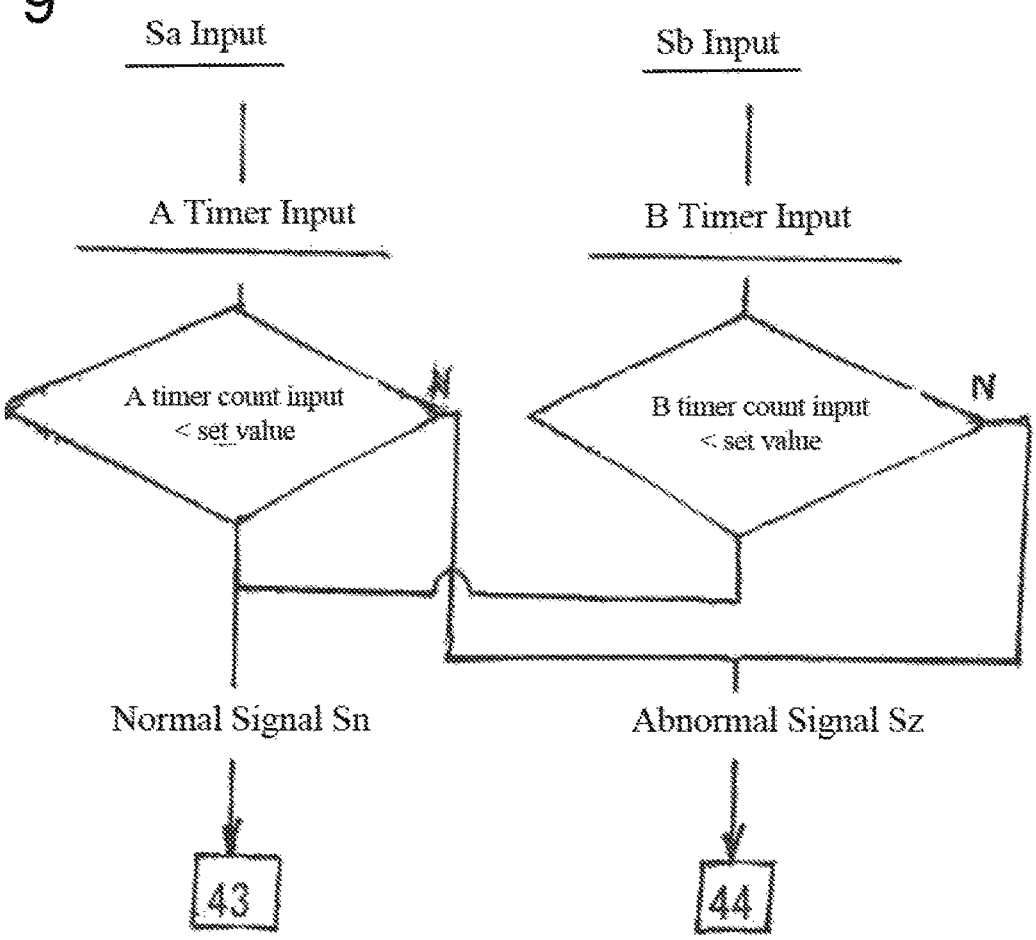
[FIG. 9] A flowchart of the same.
Figure 10:
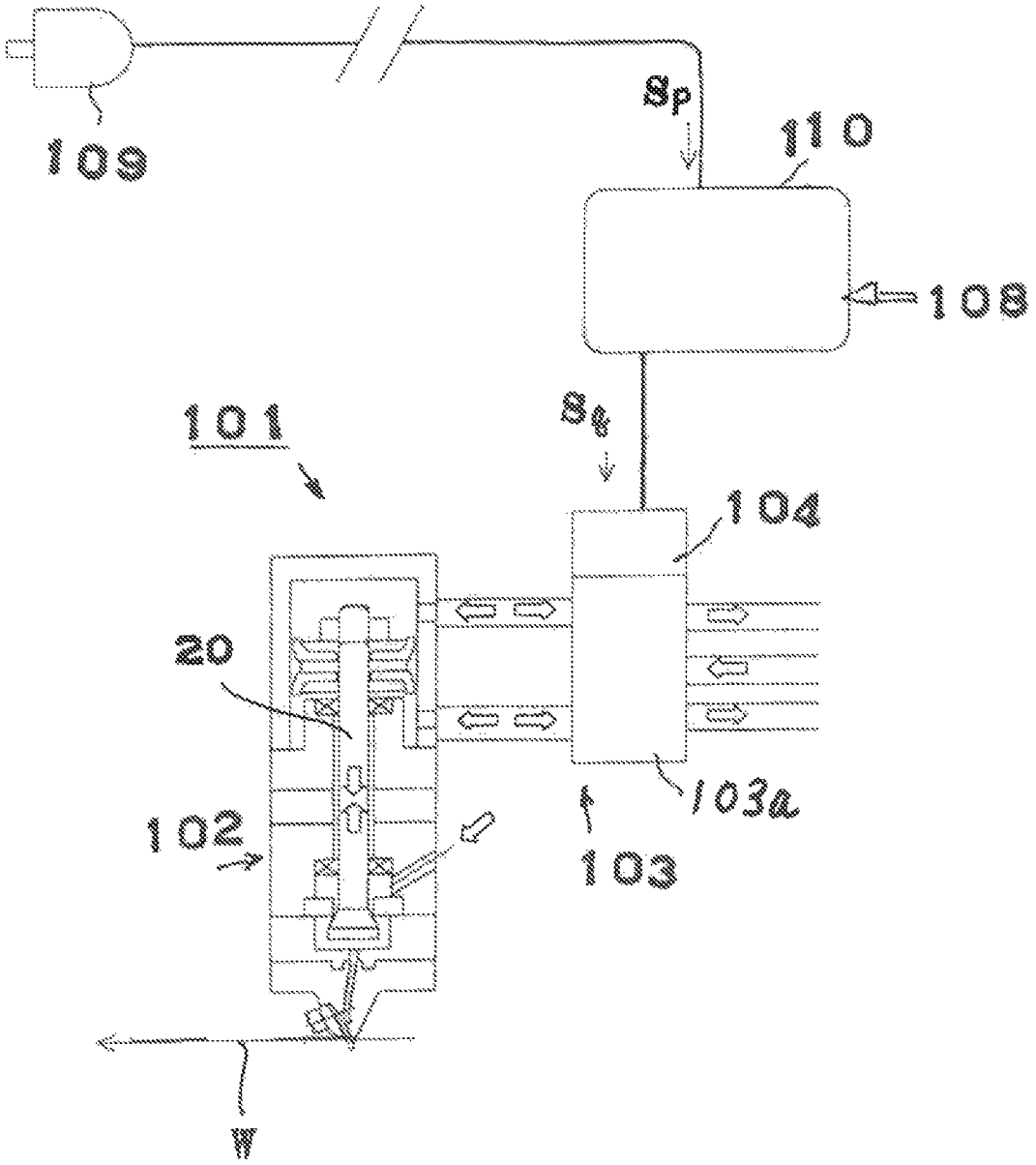
FIG. 10 PRIOR ART
[FIG. 10] A simplified diagram similar to FIG. 1, illustrating a remote operation of a suck back type intermittent coating system designed for on-site confirmation.

The operating state display device 40 is equipped with an ON operation display (blue light on) 41, an OFF operation display (yellow light on) 42, a regular operation display (white light on) 43, and an abnormality display (flashing red light) 44. As shown in FIG. 8, the computer 30 of the control device 10 is equipped with an operation remote monitoring and warning component 50.

The operation remote monitoring and warning component 50 is configured to function as:

- an A timer means 51 for measuring the duration of the ON operation display,
- a B timer means 52 for measuring the duration of the OFF operation display,
- an A determination means 53 for determining whether the numerical value of the duration A produced by the A timer means is within a set value,
- a B determination means 54 for determining whether the numerical value of the duration B produced by the B timer means is within a set value, and
- a warning means 55 for showing a normal display when the determination result of the A determination means indicates normal and the determination result of the B determination means indicates normal, and showing an abnormality warning display when the determination result of the A determination means indicates abnormal and when the determination result of the B determination means indicates abnormal.

On the basis of the generation of the displacement sensor ON detection position signal Sa, the ON operation display (blue light) 41 operates a blue light display for detecting the blue light display.

On the basis of the generation of the displacement sensor OFF detection position signal Sb, the OFF operation display (yellow light) 42 operates a yellow light display that performs the yellow light display.

The blue light display and the yellow light display are alternately flashed to determine that the operation is normal, and a regular operation display 43 (white light) operates to display a normal operation through the regular operation display (white light).

When the A determination means 53 determines that the numerical value of the duration of the ON operation display (blue light display) is outside of the set value range, the warning means 55 indicating an abnormality (flashing red display) causes an abnormality display (flashing red light) 44, and an abnormality display and warning (flashing red light, alarm, warning buzzer) is performed.

When the B determination means 54 determines that the numerical value of the duration of the OFF operation display (yellow light display) is outside of the set value range, the abnormality display (flashing red light) 44 operates to cause an abnormality display and warning (flashing red light display, alarm, warning buzzer) is performed.

As seen from the above, the present invention allows a suck back type intermittent coating system to be operated by remote control, and eliminates the need to visually check the coating surface in a conventional system.

INDUSTRIAL APPLICABILITY

In the intermittent coating that includes a suck back type intermittent coating device, the ON and OFF operation of the valve mechanism is performed by remote control under sequence control of a computer on the basis of the detection of the distal end position of a movable valve body extended portion by a displacement sensor. Therefore, confirming and setting the coating position and coating length can be ensured by remote control, which means that this invention contributes to the development of industries that requires a process to intermittently coat an adhesive to a coating base material, such as in the manufacture of disposable diapers.

DESCRIPTION OF THE REFERENCE NUMERALS

1 Suck back type intermittent coating device
2 Suck back valve mechanism
3 Valve manipulating mechanism 3*a* Five-way valve
4 Solenoid valve
5 Displacement sensor
10 Control device
20 Movable valve body
30 Computer
31 Sequence control

The invention claimed is:

1. An intermittent coating system comprising:

a suck back intermittent coating device including comprising:

a suck back valve mechanism in which a movable valve body is internally provided in a lower part space of a valve housing, a valve seat for partitioning a valve chamber formed in the lower part space of the valve housing is provided, the movable valve body is provided at a lower end thereof with an enlarged part, and the suck back valve mechanism being configured to produce a suck back effect at a time of an up and down motion of the movable valve body; and wherein:

an internal space of an upper part of the valve housing is vertically partitioned with a partition, forming an upper inner chamber and a lower inner chamber;

an extended portion of the movable valve body is passed through and fixed to the partition; and a side wall of the valve housing is provided with a first operating air opening opens into the upper inner chamber and a second operating air opening in the lower inner chamber; and a solenoid valve for selectively supplying operating air to the first operating air opening and to the second operating air opening, and a displacement sensor configured to detect a distal end position of the extended portion of the movable valve body of the suck back intermittent coating device; and a sequence controller of a computer, the sequence controller inputting detection signal from the displacement sensor and selectively outputting a solenoid valve ON operation signal and a solenoid valve OFF operation signal which are for selectively controlling supply of operating air to the first operating air opening and to the second operating air opening; and wherein, on a basis of the detection signal from the displacement sensor, an ON operation and OFF operation of the suck back valve mechanism is remotely controlled by a sequence control of the computer.

* * * * *